US010034582B2

(12) United States Patent
Farahbakhsh

(10) Patent No.: US 10,034,582 B2
(45) Date of Patent: Jul. 31, 2018

(54) INFANT WASHER AND DIAPER-CHANGER APPARATUS AND METHOD

(71) Applicant: Iman Farahbakhsh, Quchan (IR)

(72) Inventor: Iman Farahbakhsh, Quchan (IR)

( * ) Notice: Subject to any disclaimer, the term of this patent is extended or adjusted under 35 U.S.C. 154(b) by 0 days.

(21) Appl. No.: 15/406,569

(22) Filed: Jan. 13, 2017

(65) Prior Publication Data

US 2017/0143168 A1 May 25, 2017

(30) Foreign Application Priority Data

Jan. 13, 2016 (IR) ..... 139450140003011706

(51) Int. Cl.

| | |
|---|---|
| ***A47K 3/28*** | (2006.01) |
| ***A47D 5/00*** | (2006.01) |
| ***A47K 7/08*** | (2006.01) |
| ***A47K 10/48*** | (2006.01) |
| ***E03C 1/046*** | (2006.01) |
| ***A47K 3/024*** | (2006.01) |
| ***A47K 3/12*** | (2006.01) |
| *E03C 1/04* | (2006.01) |

(52) U.S. Cl.

CPC ..... *A47K 3/282* (2013.01); *A47D 5/00* (2013.01); *A47K 3/024* (2013.01); *A47K 3/127* (2013.01); *A47K 7/08* (2013.01); *A47K 10/48* (2013.01); *E03C 1/046* (2013.01); *E03C 2001/0418* (2013.01)

(58) Field of Classification Search

CPC . A47K 3/282; A47K 7/00; A47K 7/08; A47K 10/00; A47K 10/48; A47K 3/024; A47K 3/125; A47K 3/127; A47D 5/00; E03C 1/046; E03C 2001/0418; D06F 41/00

See application file for complete search history.

(56) References Cited

U.S. PATENT DOCUMENTS

| | | | | | |
|---|---|---|---|---|---|
| 2,193,374 | A | * | 3/1940 | Notter | A47K 3/024 4/572.1 |
| 2,328,893 | A | * | 9/1943 | Conrad | A47K 7/08 4/420.1 |
| 3,483,572 | A | * | 12/1969 | Gyda | A47K 3/28 134/72 |
| 5,465,437 | A | * | 11/1995 | Herman | A47K 3/122 297/344.24 |
| 5,802,647 | A | | 9/1998 | Helmsderfer | |

(Continued)

FOREIGN PATENT DOCUMENTS

| | | | | |
|---|---|---|---|---|
| CA | 2854535 | * | 6/2014 | A47K 3/024 |

*Primary Examiner* — J. Casimer Jacyna
(74) *Attorney, Agent, or Firm* — NovoTechIP International PLLC

(57) ABSTRACT

A washer and diaper-changing apparatus includes a main chamber, a glass window, a seat, a leg holder, a safety belt, a diaper removing arm, a sprinkler, and a dryer. The main chamber is configured to receive an infant therein. The glass window is placed on a top wall of the main chamber. The seat is movably coupled to the main chamber and configured for placement of the infant on the seat. The leg holder is movably coupled to the main chamber and configured to support at least one leg of the infant. The safety belt is coupled to the seat and configured to retain the infant on the seat. The sprinkler is placed inside the main chamber and configured to spray water to wash at least a portion of the infant.

17 Claims, 8 Drawing Sheets

(56) References Cited

U.S. PATENT DOCUMENTS

| | | | | |
|---|---|---|---|---|
| 6,962,005 | B1 * | 11/2005 | Khosropour | A47K 10/48 34/218 |
| 9,179,805 | B1 * | 11/2015 | Spratt-Anderson | A47K 3/282 |
| 2016/0198908 | A1 * | 7/2016 | Hartdorn | A47K 3/024 4/568 |
| 2017/0020760 | A1 * | 1/2017 | Sang | A61G 9/003 |
| 2017/0105583 | A1 * | 4/2017 | Taft | A47K 3/024 |

* cited by examiner

200

INFANT WASHER AND DIAPER-CHANGER APPARATUS AND METHOD

CROSS REFERENCE TO RELATED APPLICATION

This application claims the benefit of priority to an Iran Application Serial Number 139450140003011706 filed on Jan. 13, 2016, which is incorporated by reference herein in its entirety.

TECHNICAL FIELD

The present disclosure relates generally to devices and methods for restraining an infant during diaper-changing. More specifically, the present disclosure relates, for example, to household, hospital and/or commercial devices and methods for changing the diapers and washing infants.

BACKGROUND

Changing diapers is an art that many parents or caregivers may find difficult to acquire or perform conveniently. When the need arises, the parent or caregiver may, for example, open up the diaper bag to get a cleaning tissue and a diaper and while holding the infant's feet may clean the infant, get infant skin protectant such as talcum powder or skin lotion, apply the same to the infant, and finally put the new diaper on the infant, all being done manually by hand. While doing these tasks, the parent may further need to restrain the hands of the infant who is extremely curious and attempts to grab on to material in the vicinity. This can be inconvenient or stressful for the parent or caregiver especially for a parent and a caregiver that is handicapped in some way.

Hence a need exists for an infant washer and diaper changing apparatus that can reduce or eliminate the inconvenience associated with changing diapers of the infants as well as reducing the water consumed during changing diapers of the infant.

SUMMARY

In view of the foregoing it is an object of the present invention to provide an infant changing and washing apparatus configured to provide a platform for supporting an infant, removing a soiled diaper, and dispensing a fresh disposable diaper. In one implementation, the infant changing and washing apparatus may automatically change the diaper of an infant and wash and dry the infant. The infant changing and washing apparatus may be a light, compact, and easily portable and may be comparable to the commercial washing machines in size and shape. The apparatus may include an outlet bin for the used diaper, or may conveniently be used in connection with a washing apparatus to subsequently wash the diaper. The apparatus further may wash and dry the infant.

The apparatus may be said to be automatic in some implementations, in that once the infant is placed inside the apparatus, various steps may in some cases by carried out automatically without needing the operator to touch the infant or interact manually with the diaper or infant during the changing process, which may create a more sanitary environment for the ambient area and the operator's hands.

In some aspects, the infant washer and diaper changer apparatus includes a main diaper-changing chamber, an upper glass window, a seat, an infant leg holder, a first safety belt, a second safety belt, a third safety belt, a movable mounting rail, an outlet bin, a diaper removing arm, an adjustable curtain, a first sprinkler, a second sprinkler, a dryer, and a clamp.

In some aspects, the main diaper-changing chamber may include two housing portions: an outer housing portion which is made of galvanized iron, and an inner housing portion which is made of stainless steel or a water resistive polymer. A motor is located behind the infant washer and diaper-changing apparatus to move the moving parts of the apparatus.

In some aspects, the upper part of the main diaper-changing chamber is see-through glass window in order to isolate the apparatus form the ambient to reduce the water to splash during the rinsing and to contain the odors inside the main diaper-changing chamber. Furthermore, the glass window allows the operator to monitor the diaper-changing and infant washing process entirely. A comfortable seat is provided to hold the infant. The cover of the seat may be made of commercially available soft materials for children and it should be water proof. A leg holder which may be an adjustable strip of fabric holds the legs of the infant and each leg is fastened by an adjustable safety belt and to both sides of the leg holder. Furthermore, an adjustable safety belt is provided to prevent the infant from rolling from the seat. The seat moves by the motor via a rail inside the main diaper-changing chamber.

An outlet bin to dispose of the soiled diaper is provided inside the main diaper-changing chamber. The outlet bin may be removed and washed easily. A diaper removing arm is provided in the form of a fork-like apparatus which removes the soiled diaper from the body of the infant and releases it to the outlet bin.

The infant washer and diaper changer apparatus may wash the infant after removing the soiled diaper. There are two sprinklers above and beyond the infant seat to wash the infant with desired water temperature and duration. Furthermore, an adjustable curtain is provided to prevent wetting the new diaper. The curtain may be a commercially available bath curtain. A dryer may dry the infant after the infant is washed by the sprinklers. The dryer is located above the infant seat and next to the top sprinkler.

In an aspect of the present disclosure, the outlet bin may be coupled to a washing apparatus which is separate from the automatic infant washer and diaper changer apparatus.

In another aspect of the present disclosure, a control and display panel (such as, for example a touch screen display) may be provided outside the main diaper-changing chamber. The user may be able to determine the temperature of the water and duration of the washing process. The user is able to abort the process at any time during the infant washing and diaper-changing process; e.g. as the child feels uncomfortable.

It should be noted that, various components described herein may be varied from the illustrated size and shape to also be used to wash and change a diaper for a senior person or any person with disabilities.

BRIEF DESCRIPTION OF THE DRAWINGS

Features of the subject technology are set forth in the appended claims. However, for purpose of explanation, several implementations of the subject technology are set forth in the following figure.

DETAILED DESCRIPTION

Figure 1A:
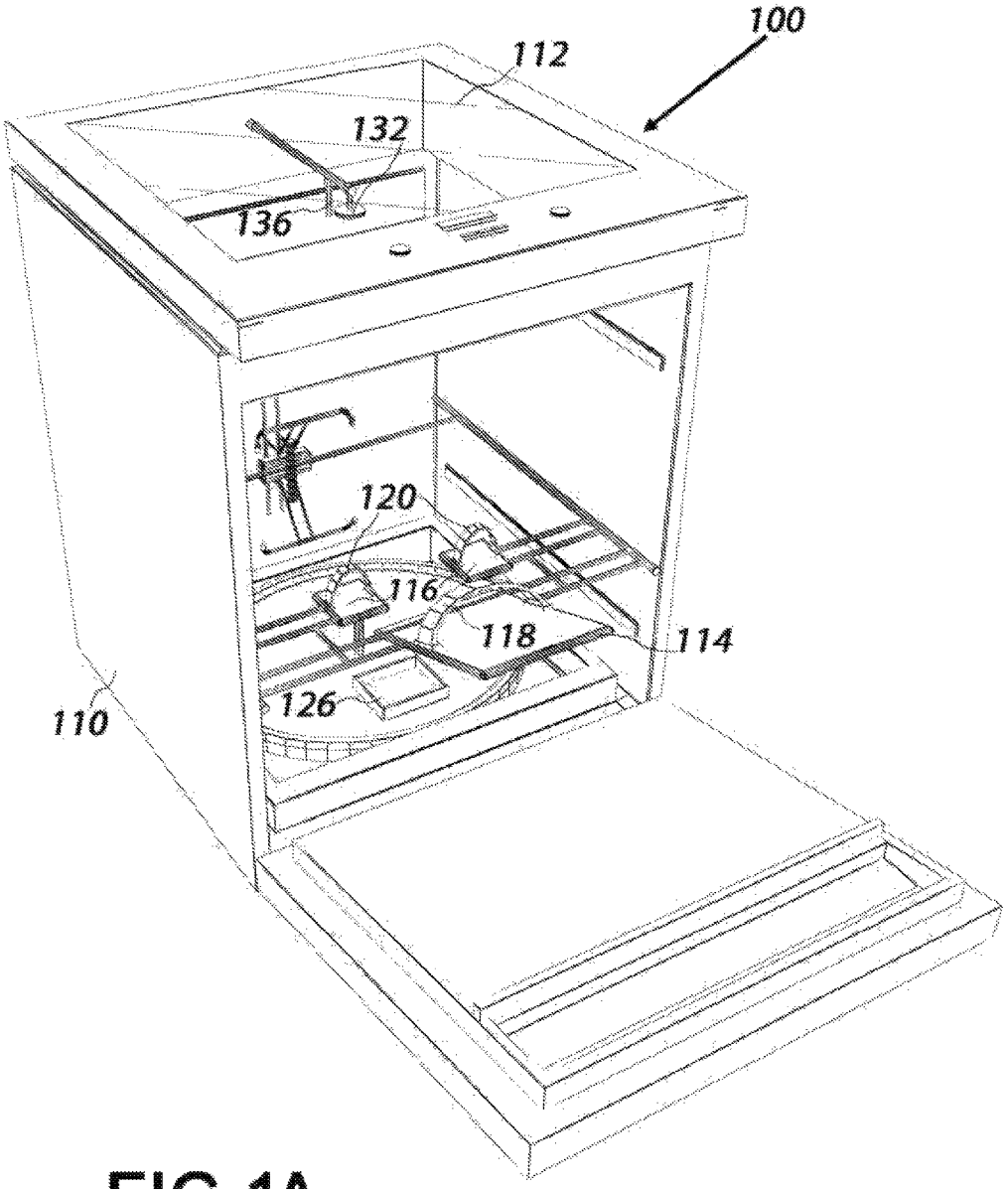
FIG. 1A is a perspective view of an automatic infant washer and diaper-changing apparatus according to an implementation of the disclosure.
Figure 1B:
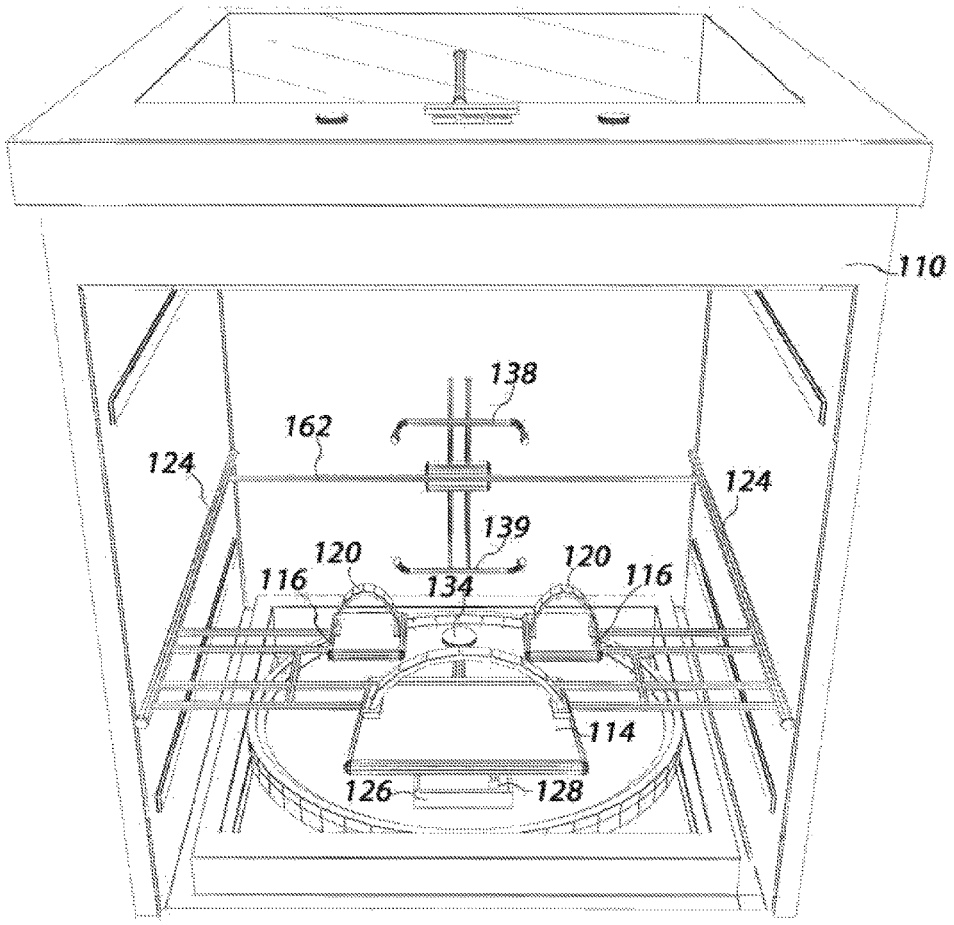
FIG. 1B is a front view of the automatic infant washer and diaper-changing apparatus shown in FIG. 1A.
Figure 1C:
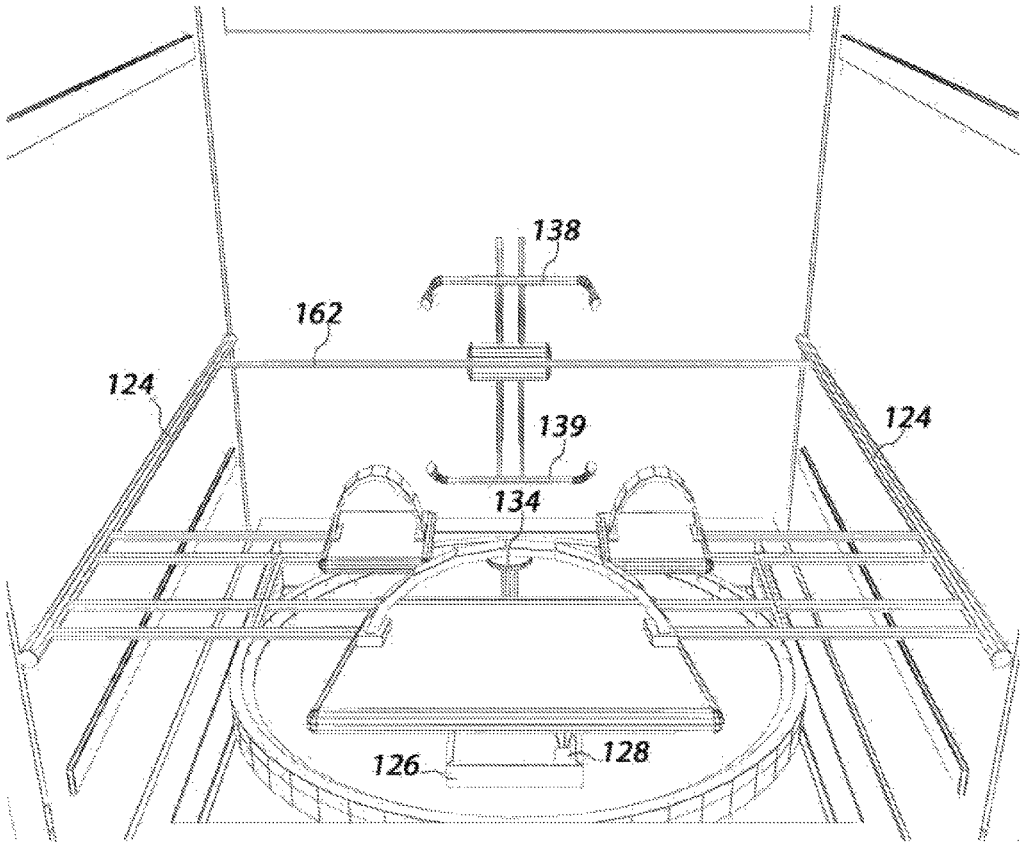
FIG. 1C shows the inside view of the automatic infant washer and diaper-changing apparatus shown in FIG. 1A.

In the following detailed description, various examples are presented to provide a thorough understanding of inventive concepts, and various aspects thereof that are set forth by this disclosure. However, upon reading the present disclosure, it may become apparent to persons of skill that various inventive concepts and aspects thereof may be practiced without one or more details shown in the examples. In other instances, well-known procedures, operations, and materials have been described at a relatively high-level, without detail, to avoid unnecessarily obscuring description of inventive concepts and aspects thereof.

In one implementation, the instant application describes an infant washing and diaper-changing apparatus with a see-through lid on top along with an infant washing and diaper-changing method. The infant is put on a comfortable seat and his/her legs and waist are fastened to a leg holder by safety belts to prevent the infant from rolling from the seat. The apparatus removes the soiled diaper and rolls a fresh diaper around the infant through a removing arm and a clamp, respectively. A sprinkler arrangement above the seat washes the infant and a dryer dries the infant. An adjustable curtain is provided to protect the new diaper from getting wet when the infant is being washed. The apparatus may be said to be automatic in some implementations, in that once the infant is placed inside, various steps may in some cases by carried out without needing the operator to touch the infant or interact manually with the diaper or infant during the changing process, which may create a more sanitary environment for the ambient area and the operator's hands.

With reference to FIGS. 1A-1E, an example of an implementation of the automatic infant washer and diaper-changing apparatus will be described. The automatic washer and diaper-changing apparatus 100 includes a main diaper-changing chamber 110, an upper glass window 112, a seat 114, an infant leg holder 116, a first safety belt (yellow color) 118, a second safety belt 120, a third safety belt 122, rails 124, an outlet bin 126, a diaper removing arm 128, an adjustable curtain 130, a first sprinkler 132, a second sprinkler 134, a dryer 136, a first clamp 138 and a second clamp 139.

The chamber 110 may be a container with a flat base and sides, typically square or rectangular and having a lid. The outer portion of the chamber 110 may be made of galvanized iron. The inner portion of the main diaper-changing chamber 110 may be made of stainless steel or a water resistive polymer. The main diaper-changing chamber 110 may house a motor (not shown) to move the moving parts of the apparatus. The moving parts of the apparatus may include the removing arm 128, the adjustable curtain 130, the first and second sprinkler 132, 133, the first and second clamp 140. The motor may also be used to enable the dryer. In a slightly different implementation, the motor may be placed outside of the main diaper-changing chamber 110. In one specific example, the motor is placed behind the infant washer and diaper-changing apparatus.

The upper part of the main diaper-changing chamber 110 is covered by a see-through glass window 112 in order to isolate the apparatus 100 form the ambient to reduce the water to splash during the rinsing and to contain the odors inside the main diaper-changing chamber 110. The glass window 112 allows the operator to monitor the diaper-changing and infant washing process as it is performed.

The seat 114 is provided inside the main diaper changing chamber 110 to hold the infant. The cover of the seat may be made of commercially available soft materials for children and it should be water proof. Also provided inside the main diaper changing chamber 110 are leg holders 116. Each leg holder 116 may be an adjustable strip of fabric and configured to hold or enable resting of the infant's leg. The infant's leg may be secured to the leg holders 116 via the safety belts 120 and 122.

Furthermore, an adjustable safety belt 118 is provided inside the main diaper-changing chamber 110 to prevent the infant from rolling from the seat 114. The seat 114 may be positioned on a bar. The bar may be an iron may and may be supported at each end by a rail 124 inside the main diaper-changing chamber 110. The rail 124 includes is slidable forward and backward on side mounts to allow the infant to be moved into and out of the main diaper-changing chamber 110. The main diaper-changing chamber 110 also includes a front door. The front door is configured to move between an open position and closed position. To open, the front door pivots downwardly to permit entry and exit of the seat 114, and hence placing and removal of the infant. Once the infant is placed inside the main diaper-changing chamber 110 or taken outside of the main diaper-changing chamber 110, the front door may be closed.

An outlet bin 126 to dispose of the soiled diaper may be provided inside and at the bottom of the main diaper-changing chamber 110. As the seat 114 moves into the main diaper-changing chamber 110, a contact between a diaper removing arm 128 and the diaper will remove the soiled diaper. The soiled diaper will be dropped to the outlet bin 126 which is located under the seat 114. In one implementation, the diaper may be unfastened prior to placing the instant on the seat 114 or shortly after placing the infant on the seat 114 and before moving the seat 114 into the chamber 110. For example, if the old diaper is a button type diaper, the old diaper may be unbuttoned by the user prior to placing the infant on the seat 114. For another example, if the old diaper is a strapped type diaper, the old diaper may be unstrapped by the user prior to placing the infant on the seat 114.

The automatic infant washer and diaper-changing apparatus 100 also includes a diaper-removing arm 128. The diaper removing arm 128 is a fork-like apparatus which removes the soiled diaper from the body of the infant and releases it to the outlet bin 126. The outlet bin 126 may be removed and washed easily. In operation, the user (e.g., a parent) may unfasten the old diaper and secure the infant to the seat 114. Then, the seat 114 may be moved inside of the chamber 110 and as the seat 114 is moving inside the chamber 110 the diaper removing arm 128 which is placed under the seat 114 comes into contact with the old diaper and causes the old diaper to fall into the outlet bin 126. The diaper removing arm 128 may be a fork like arm with an adhesive surface and may be positioned such that it comes into contact with the diaper without touching the baby.

In operation, the automatic infant washer and diaper-changing apparatus 100 may include a control panel. The control panel may be placed on apparatus 100. In one specific example, the control panel may be placed on the upper part of the chamber 110 next to the glass window 112. In another example, the control panel may be placed on the side of the chamber 110 or any other locations on the outer portion of the apparatus 100. The control panel may have an ON and OFF button to turn ON and OFF the apparatus 100. Additionally or alternatively, the control panel may have a button for opening and closing the front door of the chamber 110. Activation of this button may result in the front door of the chamber 110 opening and the seat 114 moving outward from the interior space of the chamber 110. In one implementation, the seat 114 may be fully moved outside of the interior space of the chamber 110. In another implementation, the seat 114 may be partially moved outside of the chamber 110. In either case, once the infant is placed on the seat and fasten thereto, the close button may be activated. The closed button may be the same button as the button for opening the front door or it may be a different button. The activation of the closed button may result in the seat 114 moving inside the chamber 110 and the front door of the chamber closing.

In a slightly different implementation, the front door of the chamber 110 may be manually operated. For example, the user may manually open and close the front door of the chamber 110. Once the front door of the chamber 110 is open, the user may activate a motor placed inside the chamber 110. The motor may be configured to operate in two modes. In the first mode, the motor may be configured to move the seat 114 to outside of the chamber 114. In the second mode, the motor may be configured to move the seat 114 inside of the chamber 114.

In the first mode, the activation of the motor may result in moving the seat 114 to outside of the chamber 110. The user may then place the infant on the seat 110 and activate the second mode. In the second mode, the motor may be configured to move the seat 114 along with the infant to inside of the chamber 114 for replacing the old diaper with a new diaper.

Figure 1D:
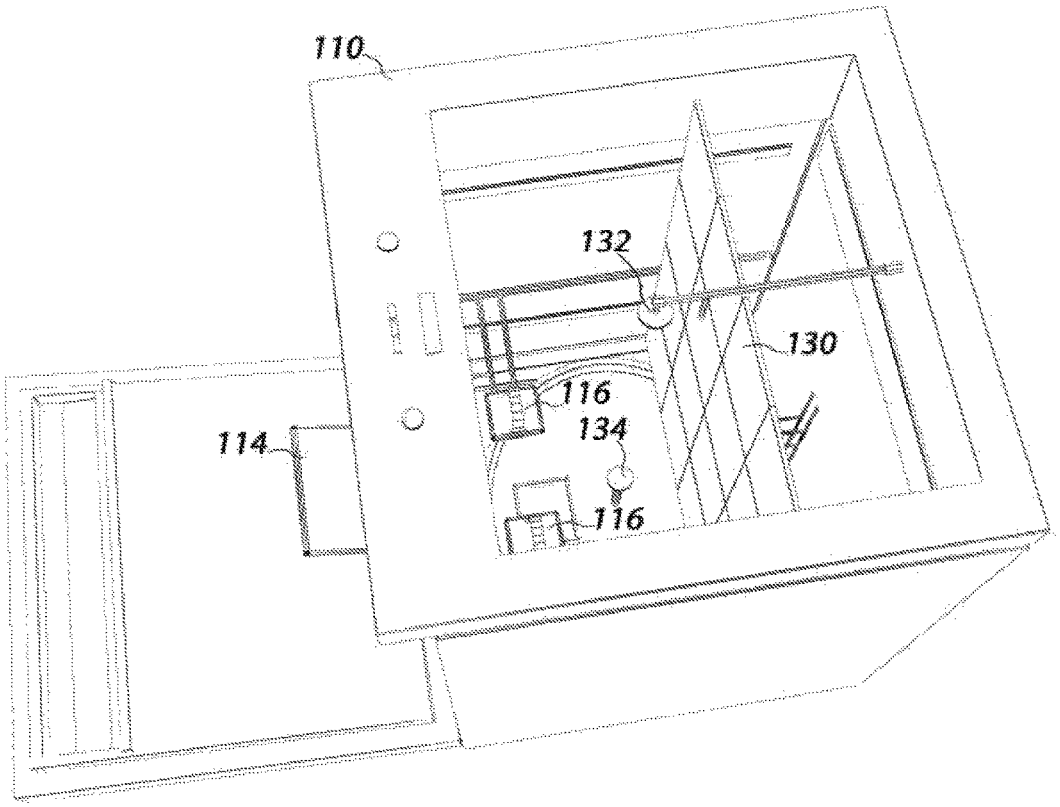
FIGS. 1D and 1E are top views of the automatic infant washer and diaper-changing apparatus shown in FIG. 1A.
Figure 1E:
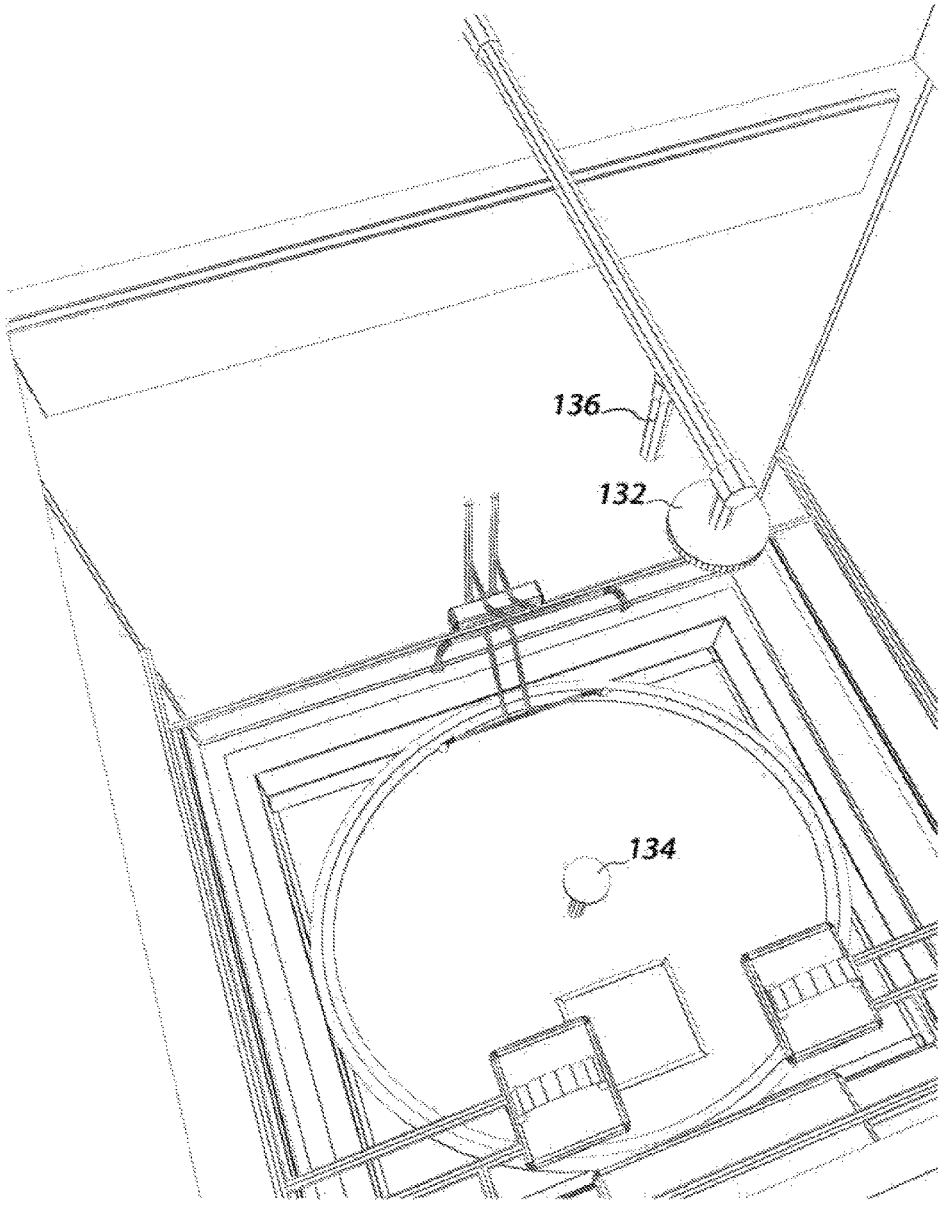

FIG. 1E shows top view of the main diaper-changing chamber 110 in accordance with one implementation of the present application. The automatic infant washer and diaper-changing apparatus 100 may wash the infant after removing the soiled diaper. To this end, the apparatus 100 may include sprinklers 132 and 134. The sprinkler 132 may be positioned above the infant above the seat 114 and the sprinkler 134 may be positioned below the infant under the seat 134.

The sprinklers 132 and 134 are configured to wash the infant with desired water temperature and duration. Furthermore, an adjustable curtain 130 as shown in FIG. 1D is provided to prevent wetting the new diaper. The curtain 130 may be made from a commercially available bath curtain. The curtain 130 may be configured to move upward and/or downward to protect the new diaper from getting wet. To this end, the curtain 130 may be connected to the side railing inside the chamber and to the motor. The motor is configured to move the curtain up and down. For example, in the second mode, the motor may be configured to move the curtain up to protect the new diaper from getting wet.

The apparatus 100 may also include the dryer 136. The dryer 136 may dry the infant after the infant is washed by the sprinklers 132 and 134 before the new diaper is placed on the infant. The dryer 136 is located above the infant seat 114 and next to the top sprinkler 132. The control panel may have a specific dryer button for activating and/or deactivating the dryer 136. The user may activate the dryer button when needed and deactivate the dryer button when it is not needed.

The apparatus 100 may also include the first clamp 138 and the second claim 139. The first clamp 138 may be positioned above the seat 114 and the second clamp 139 may be positioned below the seat. The clamps 138 and 139 are provided to roll the fresh diaper around the body of the infant. In one specific example, the clamps 138 and 139 are made of soft polymers to avoid hurting the body of the infant.

Figure 1F:
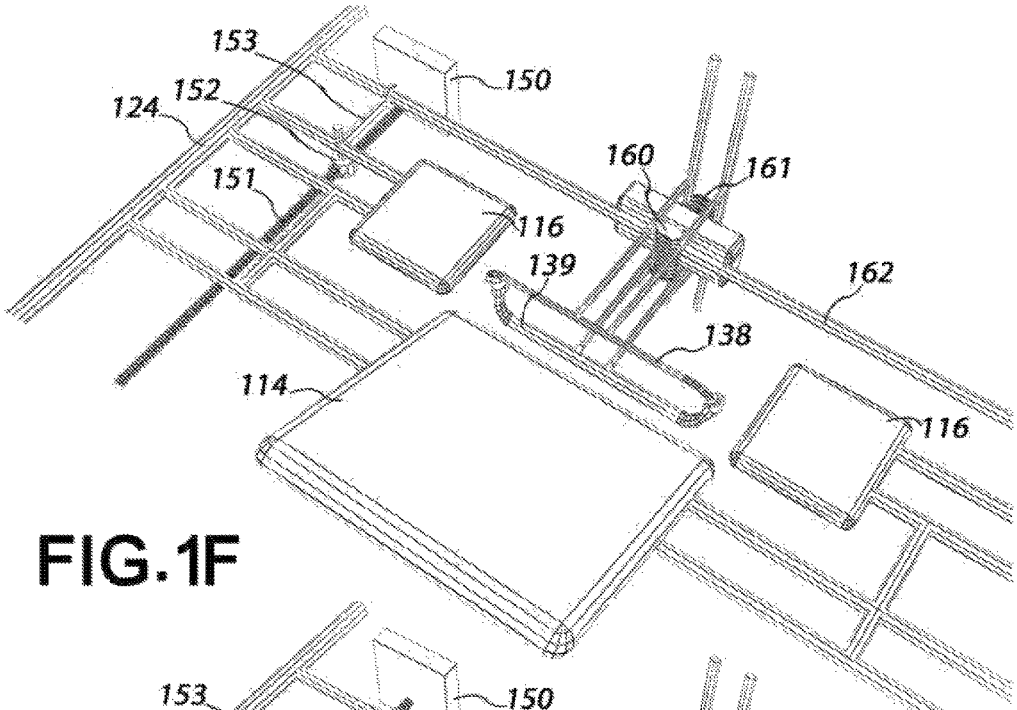
FIGS. 1F-1I illustrate the operations of a clamp assembly of the automatic infant washer and diaper-changing apparatus shown in FIG. 1A.
Figure 1G:
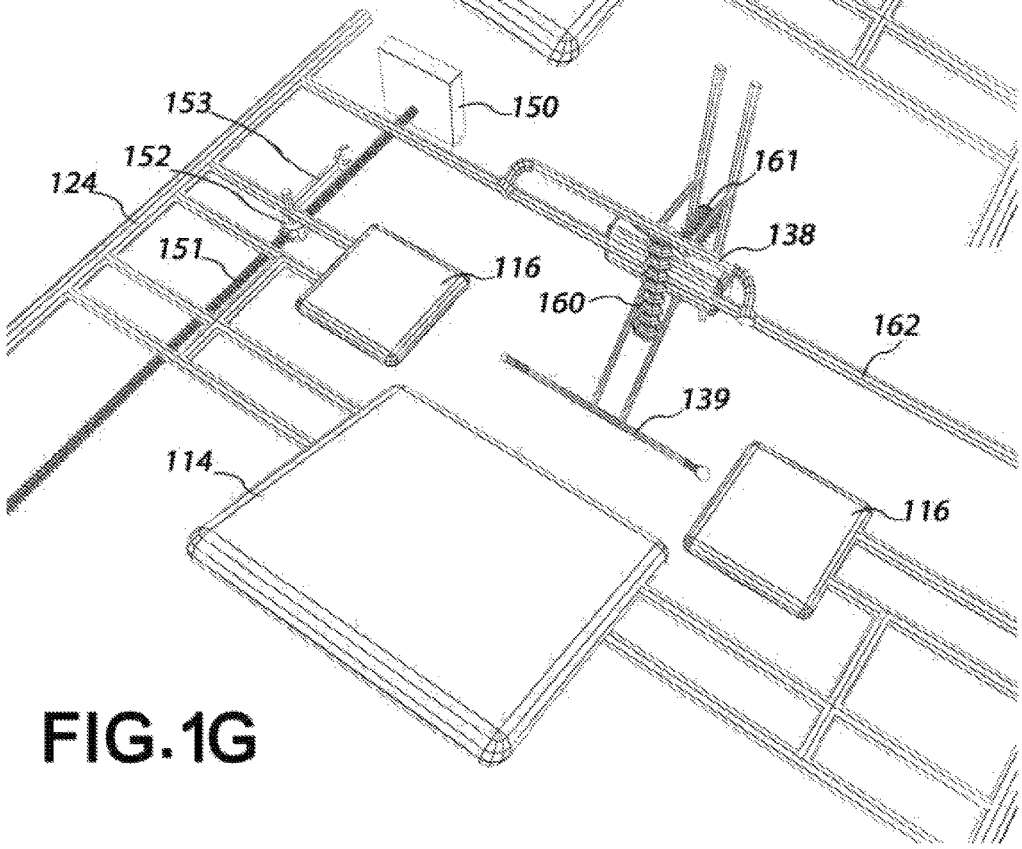
Figure 1H:
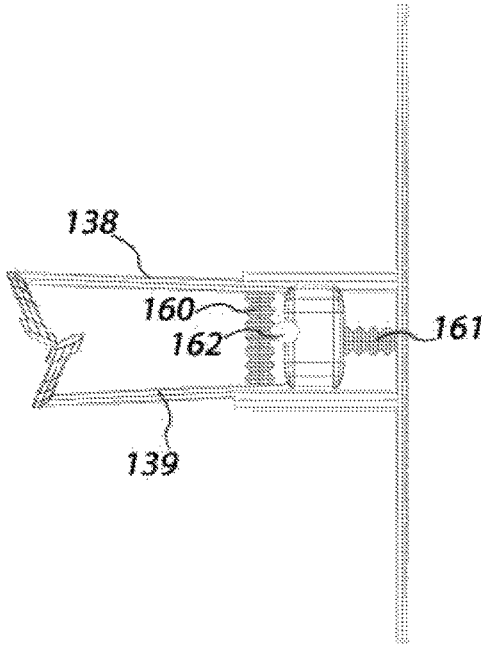
Figure 1I:
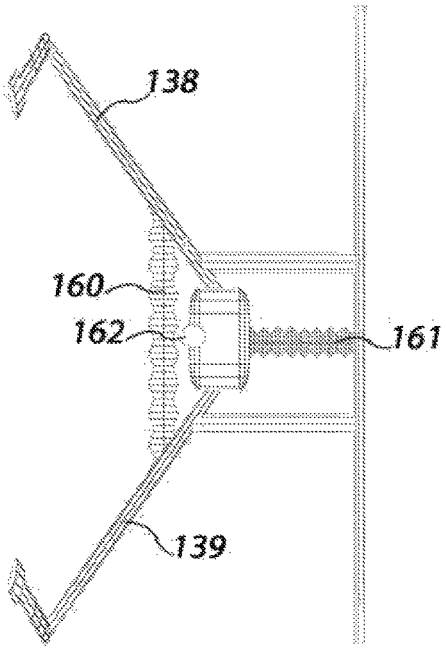

FIGS. 1F-1I illustrate the operations of a clamp assembly of the automatic infant washer and diaper-changing apparatus shown in FIG. 1A. As noted above, the clamp assembly may include clamps 138 and 139. FIG. 1F illustrates a top view of the clamp assembly being in a closed position. In FIG. 1G illustrates a top view of the clamp assembly being in an open position. FIG. 1H illustrates a side view of the clamp assembly being in the closed position. FIG. 1I illustrates a side view of the clamp assembly being in the open position.

The clamps 138 and 139 may be operated after the baby is washed and ready for placement of a new diaper. To operate the clamps 138 and 139, the apparatus 100 includes a motor 150, a long screw bar 151, a nut 152, a pushing arm 153, a first spring 161, a second spring 160, and a control rod 162. The motor 150 is located on a back wall of the main diaper-changing chamber 110 and is coupled to the long screw bar 151. The long screw bar 151 runs in parallel with the side bar 124. The long screw bar 151 may only rotate. Specifically, when the motor 150 operates in the first mode, the long screw bar 151 may rotate in a first direction and when the motor 150 operates in the second mode, the long screw bar 151 may operate in a second direction. The first direction may be opposite to the second direction. For example, the first direction may be a clockwise direction and the second direction may be a counter clockwise direction. Alternatively, the first direction may be a counter clockwise direction and the second direction may be the clockwise direction.

The nut 152 is inserted into the long screw bar 151 and is attached to a connection mechanism. The connection mechanism has three portions. The first portion is attached to the nut 152. The second portion is inserted inside the rail 124. The third portion is attached to the seat 114. When motor 150 operates in the first mode, the screw bar 151 rotates in the first direction and as a result the nut 152 may move the seat 114 away from the motor 150 toward outside of the chamber 110. The seat 114 may be moved toward outside of the chamber 110 for at least two reasons. The first is placement of the infant on the seat 114 at beginning of the diaper changing operation and the second is removal of the instant from the seat 114 at the end of the diaper changing operation.

When the motor operates in the second mode, the screw bar 151 rotates in the second direction opposite to the first direction and as a result the nut 152 may move the seat 114 toward the motor 150 and further inside the chamber 110. The seat 114 may be moved toward the motor 150 once the infant is secured on the seat 114 and is ready for his/her diaper to be changed. As the screw bar 151 rotates within the nut 152 and the nut 152 moves the seat 114 toward the motor 150, the pushing arm 153 also moves along with the nut 152 and the seat 114 toward the motor 150. In this manner, the pushing arm 153 eventually becomes in contact with the control bar 162 and pushes the control bar 162 backward. The control bar 162 at one end is coupled to the side rail 124 on one wall of the chamber 110 and at another end is coupled to the other side rail 124 on the other wall of the chamber 110. In one specific example, the end points of the control bar 162 may be configured to be received within the rail 124 and move within the rail 124.

The control bar 162 at the middle portion may be coupled to the first spring 161. The spring 161 may be an uncompressed position in a natural state. The first spring 161 may be compressed via the control bar 162 as the control bar 162 is pushed toward the motor 150 via the pushing arm 153. This may in turn result in the two clamps 138 and 139 which are coupled to each other at one end (e.g., the end coupled to the first spring 161) to move toward each other and cause the second spring 160 to compress. This in turn result in the placement of the new diaper on the infant. In the next step, the motor 150 may rotate the screw bar 151 in the first direction to move nut 152 away from the motor 150. The process may end until the seat 114 is close to or outside the main diaper-changing door.

In one implementation, the washing process may include washing and rinsing with water through the sprinklers. In another aspect of the present application, a control input and display device (such as for example, a touch screen) may be provided outside the main diaper-changing chamber 110. The user may be able to determine the temperature of the water and duration of the washing process. The automatic infant washer and diaper charger machine is equipped with a microcontroller and 12 sensors to control the entire process. In each part of the process, the location of the seat may be monitored by the sensors. The user may also be able to abort the process at any time during the infant washing and diaper-changing process (e.g., if the child feels uncomfortable).

Figure 2:
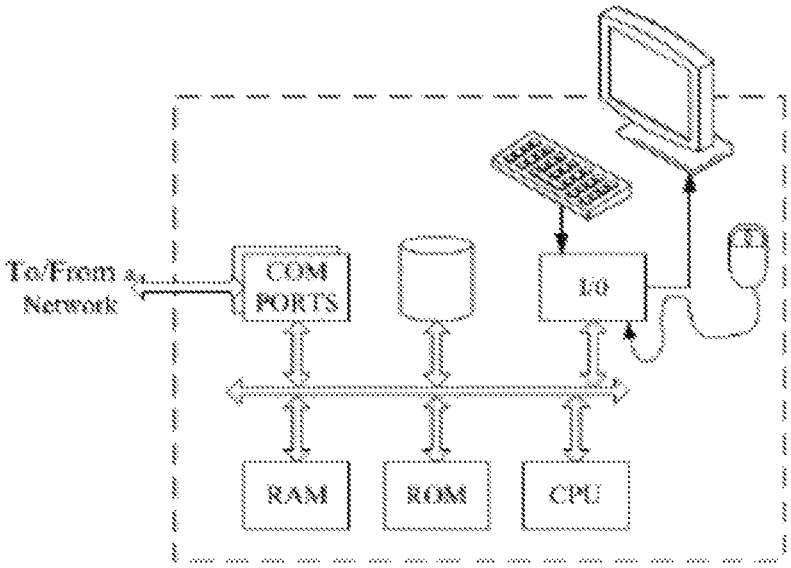
FIG. 2 depicts a computing device with user interface elements, as may be used to implement the electronic components of the apparatus shown in FIG. 1.

FIG. 2 depicts a computing device 200 with user interface elements, as may be used to implement the electronic components of the apparatus 100 shown in FIG. 1. The structure, programming and general operation of such computer equipment are well known and as a result, the drawings should be self-explanatory.

A computing device, for example, includes a data communication interface for packet data communication. The computing device also includes a central processing unit (CPU), in the form of one or more processors, for executing program instructions for implementing the instructions of the apparatus 100. The computing device platform typically includes an internal communication bus, program storage and data storage for various data files to be processed and/or communicated by the computing device, although the computing device often receives programming and data via network communications. The hardware elements, operating systems, and programming languages of such computing devices are conventional in nature. Of course, the computing device functions may be implemented in a distributed fashion on a number of similar platforms, to distribute the processing load.

A computer type user terminal device includes a data communication interface CPU, main memory and one or more mass storage devices for storing user data and the various executable programs (see FIG. 2). The apparatus 100 will also include various user input and output elements. The apparatus 100, for example, may include a keyboard and a cursor control/selection device such as a mouse, trackball, joystick or touchpad; and a display for visual outputs. Alternatively or additionally, the apparatus 100 may include a user interface element for enabling the user to activate the apparatus 100. The activation may include opening and closing the front door; causing the motor to move the seat 114 inside and outside of the chamber 110; turning ON and OFF the sprinkler and the dryer; moving the curtain 130 up and down; and moving the clamp assembly 138 and 1390 to place a new diaper on the infant. The user interface may include a specific button for each of the foregoing activities. Alternatively, the user interface may include a single button for instructing the apparatus 100 to perform all of these activities. In yet another implementation, the user interface may have a plurality buttons for instructing the apparatus 100 to perform all of these activities. The plurality of buttons may be less than the number of all the activities.

A microphone and speaker enable audio input and output. The audio input may include audio instructions to the apparatus 100 for performing the steps of washing the infant and changing his/her diaper in a manner discussed above. The hardware elements, operating systems, and programming languages of such user terminal devices also are conventional in nature.

Hence, aspects of the diaper changing apparatus may be embodied in programming. Program aspects of the technology may be thought of as "products" or "articles of manufacture" typically in the form of executable code and/or associated data that is carried on or embodied in a type of machine readable medium. "Storage" type media include any or all of the tangible memory of the computers, processors or the like, or associated modules thereof, such as various semiconductor memories, tape drives, disk drives and the like, which may provide non-transitory storage at any time for the software programming. All or portions of the software may at times be communicated through the Internet or various other telecommunication networks. Such communications, for example, may enable loading of the software from one computer or processor into another. Thus, another type of media that may bear the software elements includes optical, electrical and electromagnetic waves, such as used across physical interfaces between local devices, through wired and optical landline networks and over various air-links. The physical elements that carry such waves, such as wired or wireless links, optical links or the like, also may be considered as media bearing the software. As used herein, unless restricted to non-transitory, tangible "storage" media, terms such as computer or machine "readable medium" refer to any medium that participates in providing instructions to a processor for execution.

Hence, a machine readable medium may take many forms, including but not limited to, a tangible storage medium, a carrier wave medium or physical transmission medium. Non-volatile storage media include, for example, optical or magnetic disks, such as any of the storage devices in any computer(s) or the like, may be used to implement a simulation for calculating parameters associated with the system and method for rapid hydraulic forming of metal and non-metal sheets using magnetic fields, etc. shown in the drawings. Volatile storage media include dynamic memory, such as main memory of such a computer platform. Tangible transmission media include coaxial cables; copper wire and fiber optics, including the wires that comprise a bus within a computer system. Carrier-wave transmission media can take the form of electric or electromagnetic signals, or acoustic or light waves such as those generated during radio frequency (RF) and infrared (IR) data communications. Common forms of computer-readable media therefore include for example: a floppy disk, a flexible disk, hard disk, magnetic tape, any other magnetic medium, a CD-ROM, DVD or DVD-ROM, any other optical medium, punch cards paper tape, any other physical storage medium with patterns of holes, a RAM, a PROM and EPROM, a FLASH-EPROM, any other memory chip or cartridge, a carrier wave transporting data or instructions, cables or links transporting such a carrier wave, or any other medium from which a computer can read programming code and/or data. Many of these forms of computer readable media may be involved in carrying one or more sequences of one or more instructions to a processor for execution.

It should be noted that, various components described herein may be varied from the illustrated size and shape to also be used to wash and change a diaper for a senior person or any person with disabilities.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various implementations. This is for purposes of streamlining the disclosure, and is not to be interpreted as reflecting an intention that the claimed implementations require more features than are expressly recited in each claim. Rather, as the following claims reflect, inventive subject matter lies in less than all features of a single disclosed implementation. Thus, the following claims are hereby incorporated into the Detailed Description, with each claim standing on its own as a separately claimed subject matter.

What is claimed is:

1. A washer and diaper-changing apparatus comprising:

a main chamber configured to receive an infant therein;

a glass window placed on a top wall of the main chamber;

a seat movably coupled to the main chamber and configured for placement of the infant on the seat;

a leg holder movably coupled to the main chamber and configured to support at least one leg of the infant;

a safety belt coupled to the seat and configured to retain the infant on the seat;

a diaper removing arm placed inside the main chamber and configured to remove a used diaper from a body of the infant;

a sprinkler placed inside the main chamber and configured to spray water to wash at least a portion of the infant; and a dryer placed inside the main chamber and configured to dry at least a portion of the infant after washing.

2. The apparatus of claim 1, further comprising:

a first rail placed inside the main chamber on a first side wall, the first side wall being perpendicular to the top wall of the main chamber;

a second rail placed inside the main chamber on on a second side wall, the second side wall being parallel with the first side wall; and a seat bar at one end movably coupled to the first rail and at another end movably coupled to the second rail, wherein the seat is mounted to the seat bar and configured to into and at least partially out of the main chamber.

3. The apparatus of claim 2, further comprising a screw bar mounted inside the main chamber along the first rail and coupled to the first rail;

a motor mounted inside the main chamber and coupled to the screw bar and configured to rotate the screw bar in a first direction when the motor is operating in a first mode and in a second direction opposite to the first direction when the motor is operating in a second mode; and a fastening element movably coupled to the screw bar, the seat, and the first rail, wherein:

when the motor operates in the first mode, the screw bar operates in the first direction resulting in the fastening element moving away from the motor thereby pushing the seat toward outside of the main chamber, and when the motor operates in the second mode, the screw bar operates in the second direction resulting in the fastening element moving toward the motor thereby pushing the seat toward inside the main chamber.

4. The apparatus of claim 3, wherein:

the first direction include a clockwise or a counter clockwise direction, and the fastening element includes a nut, and the screw bar is inserted within the nut.

5. The apparatus of claim 4, further comprising:

a control bar coupled at one end to the first rail and at another end to the second rail and configured to move forward and backward within the first and second rails; on a pushing arm coupled to the nut and configured to push the control arm toward the motor when the motor is operating in the second mode;

a first spring coupled to a middle portion of the control bar and configured to compress as the control bar is pushed toward the motor;

a clamp assembly including a first clamp and a second clamp, the clamp assembly being coupled to the first spring, configured to operate between an open position and a closed position, and configured to move toward the close position as the first spring is compressed; and a second spring placed between the first clamp and the second clamp and configured to compress as the clamp assembly moves toward the close position, wherein the clamp assembly is configured to place a fresh diaper on the infant.

6. The apparatus of claim 5, further comprising a control panel configured to enable the user to operate the motor in the first mode and the second mode.

7. The apparatus of claim 6, wherein the control panel includes a first button for enabling the user to operate the motor in the first mode for moving the seat outside of the main chamber and allowing for placement of the infant on the seat.

8. The apparatus of claim 7, wherein the control panel includes a second button for enabling the user to operate the motor in the second mode for moving the seat inside the main chamber and allowing for replacement of the used diaper with a fresh diaper.

9. The apparatus of claim 8, wherein the control panel includes a button configured to activate the sprinkler and the dryer within a predetermined time from each other.

10. The apparatus of claim 8, further comprising an outlet bin at the bottom of the main chamber configured to receive the used diaper from the diaper removing arm.

11. The apparatus of claim 7, wherein the control panel includes a button for enabling the user to open and close a front door of the main chamber.

12. The apparatus of claim 1, wherein the safety belt comprises:

a first safety belt to fasten a body of the infant to the seat;

a second safety belt to fasten a first leg of the infant to the infant leg holder; and a third safety belt to fasten a second leg of the infant to the infant leg holder.

13. The apparatus of claim 1, further comprising:

an adjustable curtain configured to move laterally within the main chamber to prevent a fresh diaper from getting wet when the infant is being washed.

14. The apparatus of claim 12, wherein the sprinkler further comprises:

a first sprinkler positioned above the seat and configured to wash a top portion of the infant; and a second sprinkler positioned below the seat and configured to wash a bottom portion of the infant, wherein the dryer is disposed above the seat and next to the first sprinkler to dry the infant after washing.

15. The apparatus of claim 14, wherein the main chamber has an outside portion made of galvanized iron and an inside portion made of stainless steel.

16. The apparatus of claim 14, wherein the sprinklers are further loaded with detergent to wash the infant prior to rinsing the infant with water.

17. The apparatus of claim 14, further comprising a control panel configured to control a temperature of the water sprinkled and a duration of sprinkling process performed by the apparatus.

* * * * *